United States Patent [19]

Bardwick, III

[11] 4,104,835

[45] Aug. 8, 1978

[54] PORTABLE STAGING EQUIPMENT

[75] Inventor: John Bardwick, III, Ypsilanti, Mich.

[73] Assignee: Aztec Staging Co., Inc., Ann Arbor, Mich.

[21] Appl. No.: 780,703

[22] Filed: Mar. 24, 1977

[51] Int. Cl.[2] ..... E04H 3/28

[52] U.S. Cl. ..... 52/7; 182/179; 52/637

[58] Field of Search ..... 52/578–580, 52/7, 637, 638; 182/179, 178; 403/329, 49

[56] References Cited

U.S. PATENT DOCUMENTS

| | | | |
|---|---|---|---|
| 595,277 | 12/1897 | Winslow | 52/578 |
| 1,204,552 | 11/1916 | Ekholm | 182/179 |
| 2,294,240 | 8/1942 | Pollman | 403/49 |
| 2,555,782 | 6/1951 | Brownstein | 52/637 |
| 2,593,122 | 4/1952 | Droeger et al. | 182/178 |
| 2,629,139 | 2/1953 | Thelander | 52/578 |

FOREIGN PATENT DOCUMENTS

| | | | |
|---|---|---|---|
| 1,099,248 | 3/1955 | France | 5/282 R |
| 342,018 | 1/1931 | United Kingdom | 182/179 |

*Primary Examiner*—James L. Ridgill, Jr.
*Attorney, Agent, or Firm*—Barnes, Kisselle, Raisch & Choate

[57] ABSTRACT

A staging system composed of portable components to provide an inexpensive system which is easily assembled and disassembled and which has safety connections and strengthening elements to assure safe assembly and a level platform. A series of panels carrying adjustable supporting stanchions spaced by detachable joists on which are supported drop-in filler panels with interlock devices to assure proper lock-in of the separable parts.

4 Claims, 18 Drawing Figures

PORTABLE STAGING EQUIPMENT

This invention relates to Portable Staging Equipment and more particularly to a staging system wherein various components are provided for assembly into an extended platform for use in the entertainment field.

Many large structures which accommodate a large number of people are not provided with the proper staging for the certain entertainment events. For example, a baseball stadium or a football stadium may be used for concerts by popular musicians or classical orchestras or for religious speakers and other public events or public affairs and the stadium or arena has no permanent structure for proper presentation.

It is thus important that it be possible to set up portable platforms and staging assemblies which will in effect convert a sports arena, for example, to a concert facility.

In connection with this conversion, it is important that the staging equipment be inexpensive, light and easy to handle, and of such a construction that it may be readily assembled and disassembled with suitable interlock devices which prevent any collapsing or unsafe conditions.

It is an object of the present invention to provide a structure which is inexpensive, relatively light to facilitate handling, and having such interlocking construction that it will provide a safe platform for the assembling of large groups in either standing or sitting position.

It is a further object to provide staging which can consist of spaced, supported planes with detachable connecting joists and drop-in filler panels so that unnecessary duplication of supporting legs is avoided, thus reducing the expense and the weight of the various structures.

Other objects and features are directed to the bracing and interlocking systems which will be apparent in the following description and claims in which there is set forth the principles of the invention, together with a detailing of the structures directed to persons skilled in the art to enable them to utilize the invention, all in connection with the best mode presently contemplated for the invention.

Figure 1:
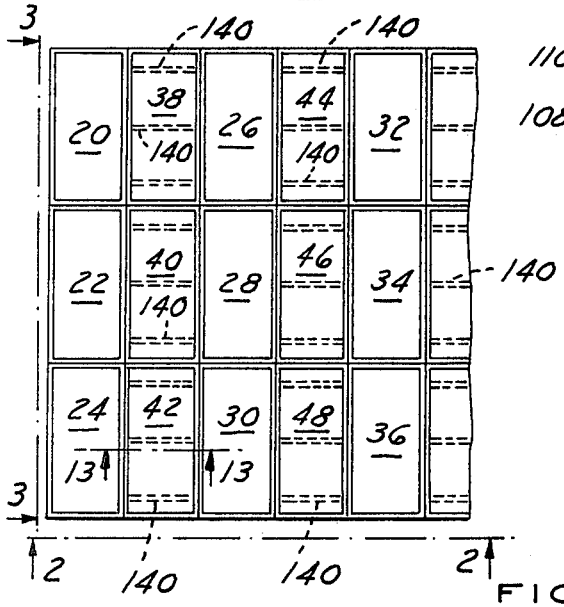

DRAWINGS accompany the disclosure and the various views thereof may be briefly described as:

FIG. 1, an overall plan view of an assembled staging unit.

Figure 2:
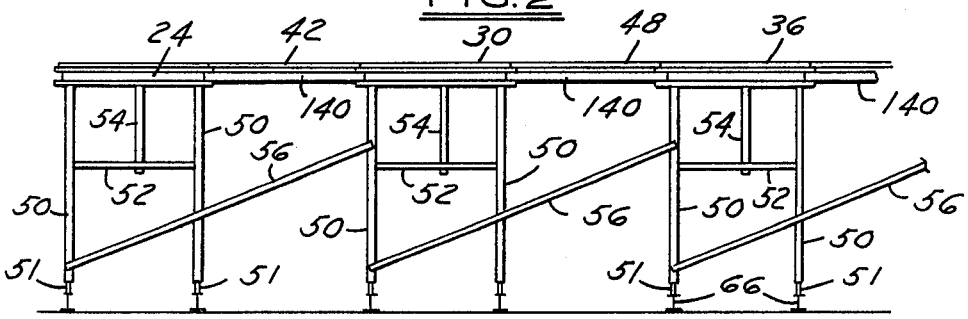

FIG. 2, an end elevation on line 2—2 of FIG. 1.

Figure 3:
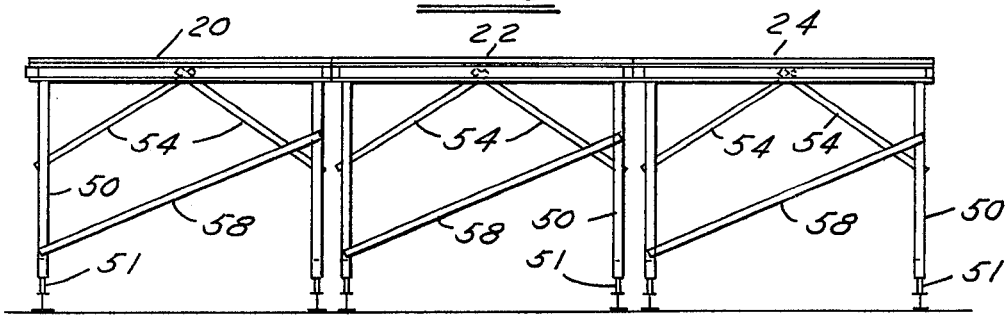

FIG. 3, a side elevation on line 3—3 of FIG. 1.

Figure 4:
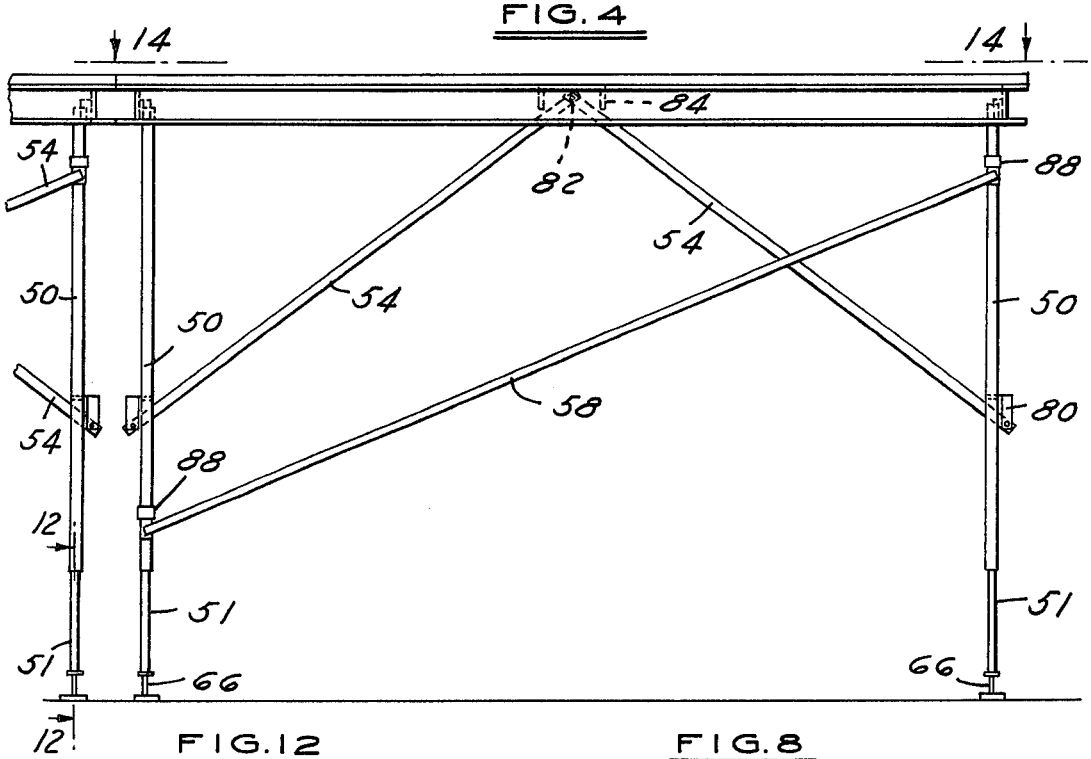

FIG. 4, an enlarged view of a single unit of the device taken from the side.

Figure 5:
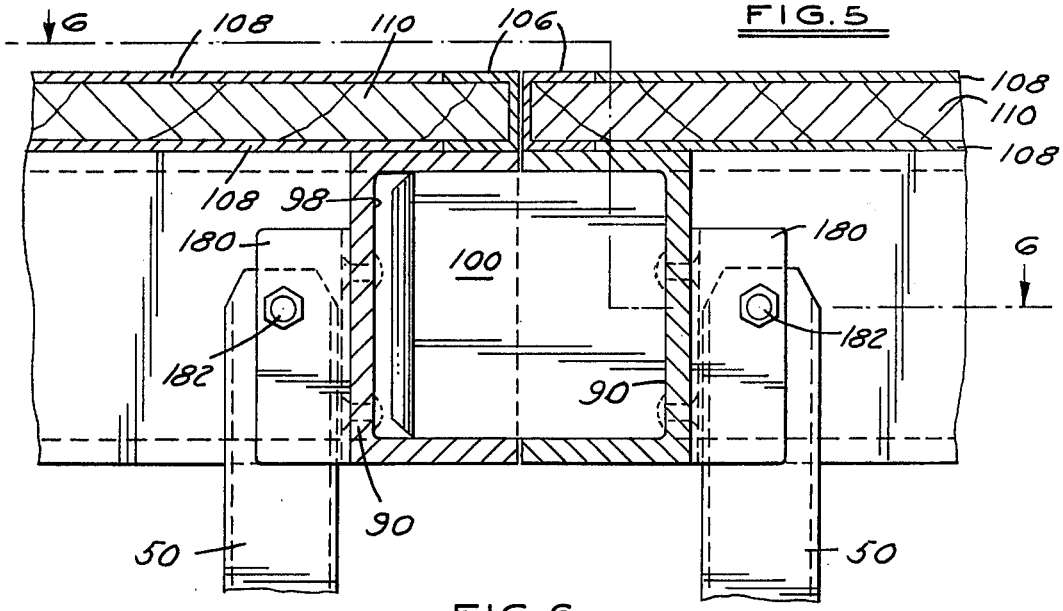
Figure 6:
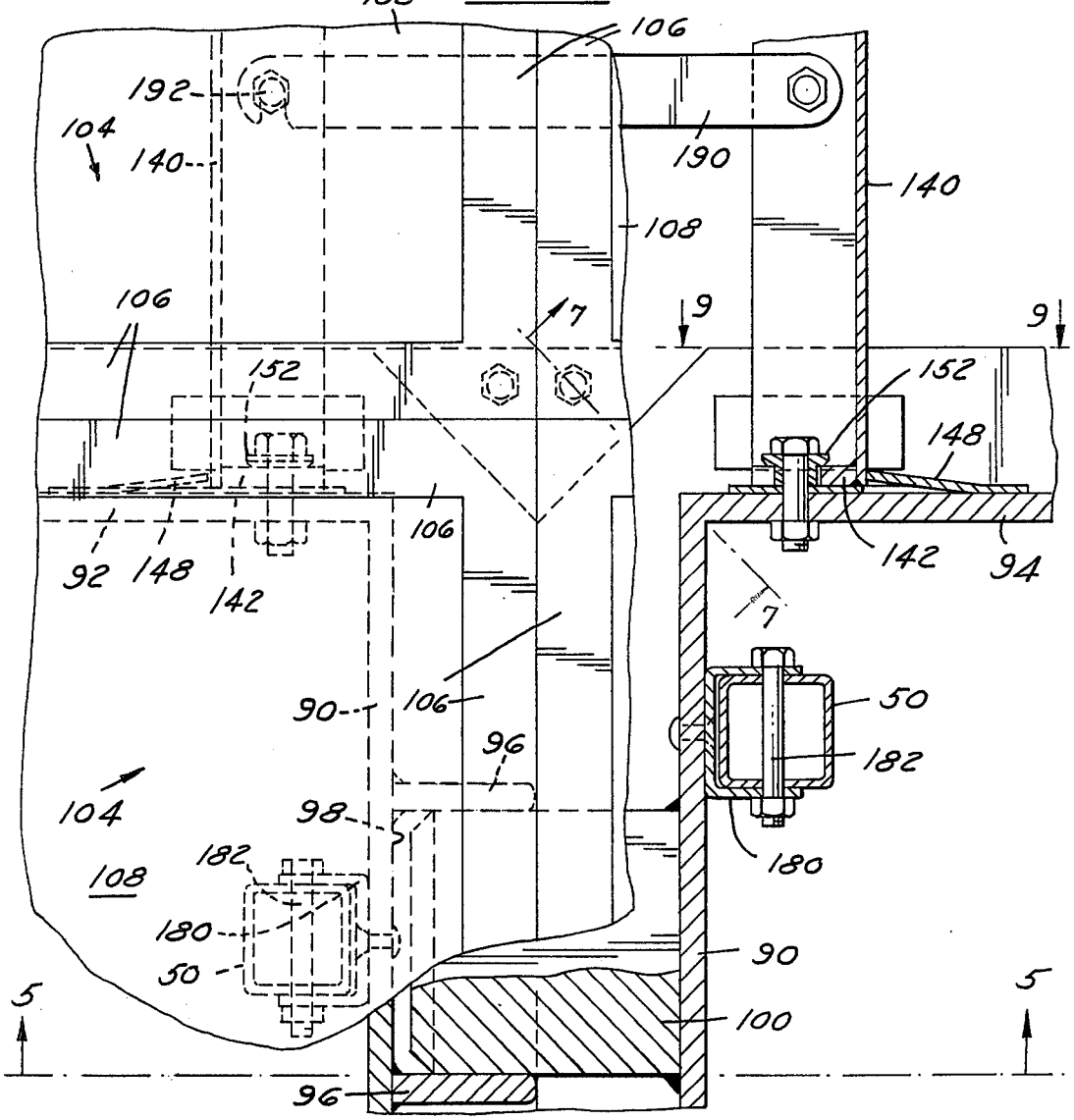

FIG. 5, a vertical sectional view on line 5—5 of FIG. 6.

FIG. 6, a top assembly view on line 6—6 of FIG. 5 of four adjacent corners of support panels.

Figure 7:
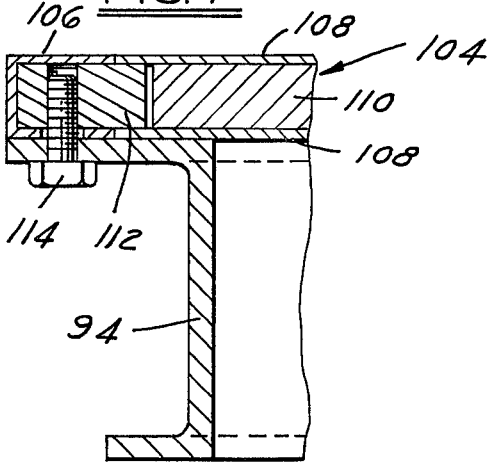

FIG. 7, a sectional view on line 7—7 of FIG. 6.

Figure 8:
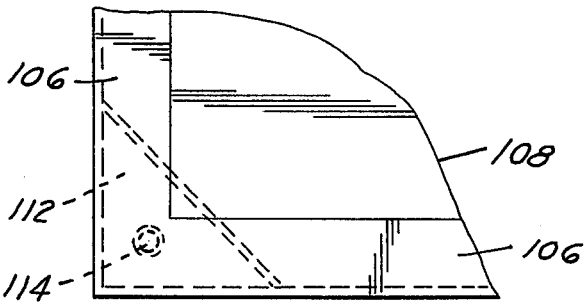

FIG. 8, a view of a panel corner.

Figure 9:
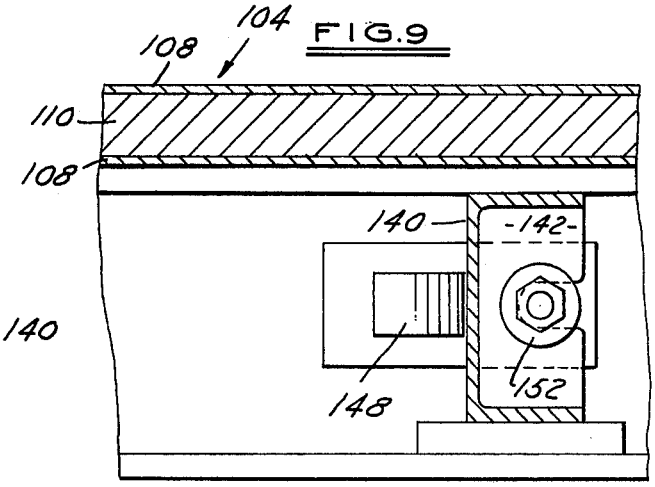

FIG. 9, a sectional view of a joist lock taken on line 9—9 of FIG. 6.

Figures 10, 11:
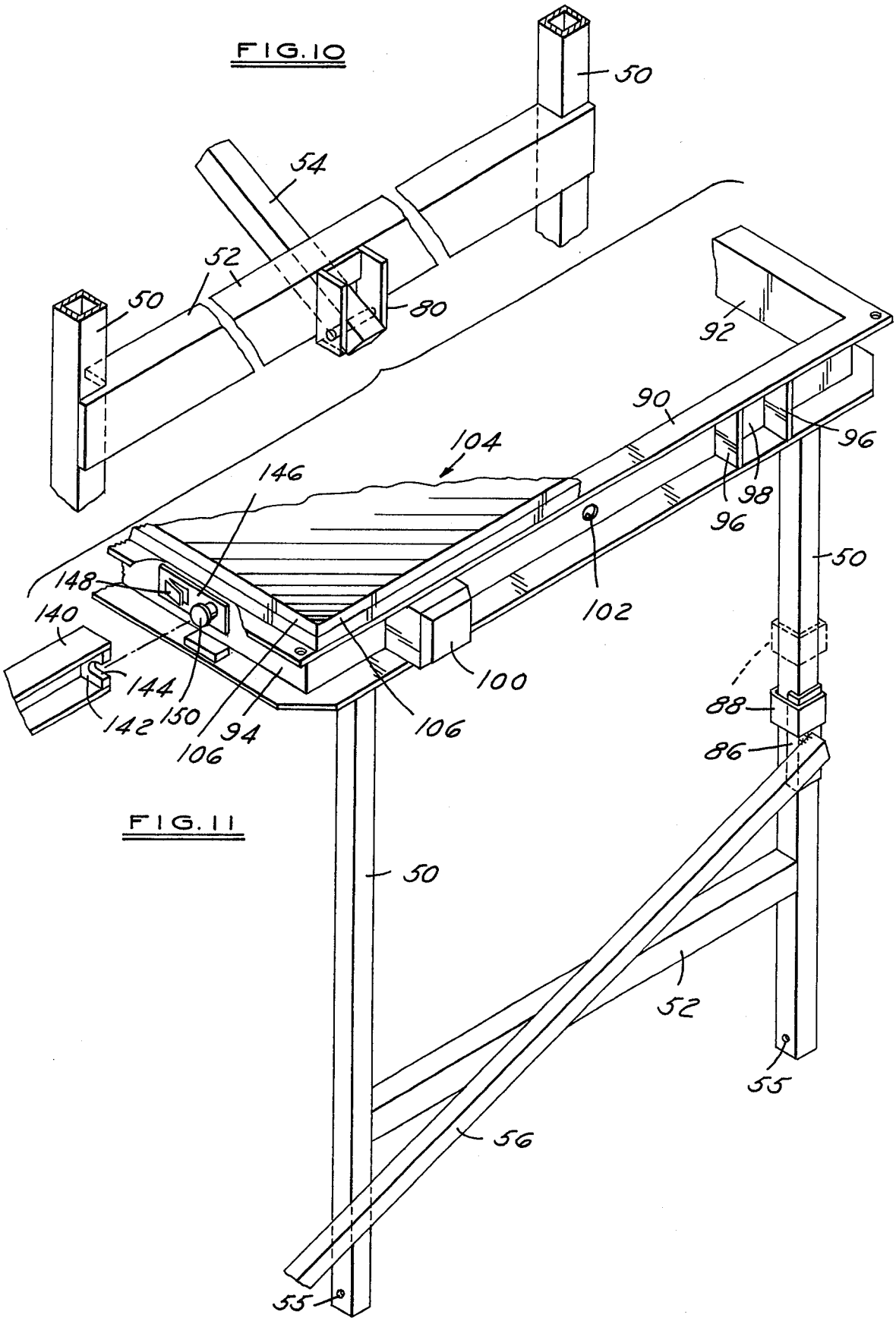

FIG. 10, a perspective view of a reinforcing support.

FIG. 11, a perspective view of an end of a platform panel.

Figure 12:
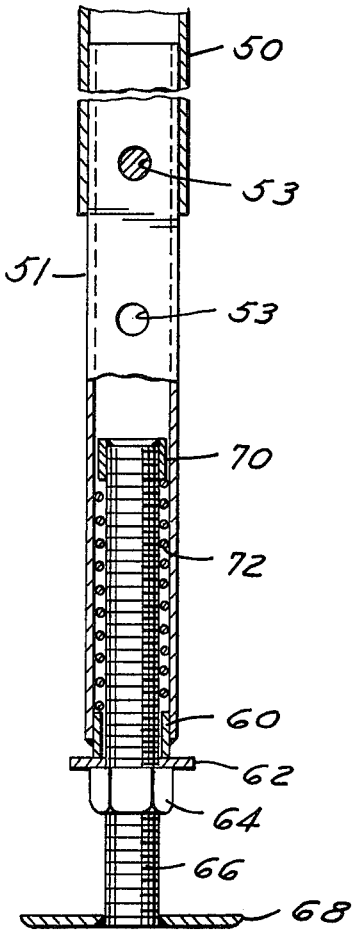

FIG. 12, a side elevation of an adjustable supporting leg.

Figure 13:
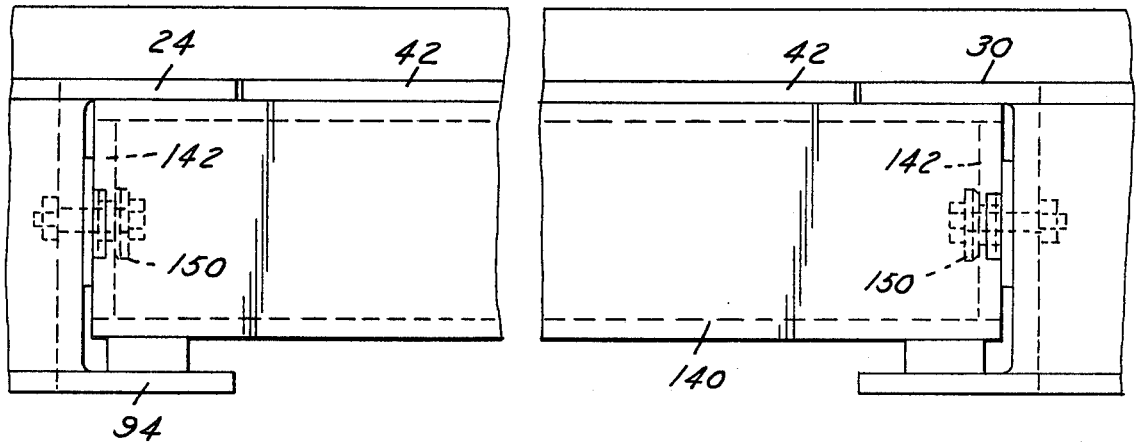

FIG. 13, a sectional view on line 13—13 of FIG. 1.

Figure 14:
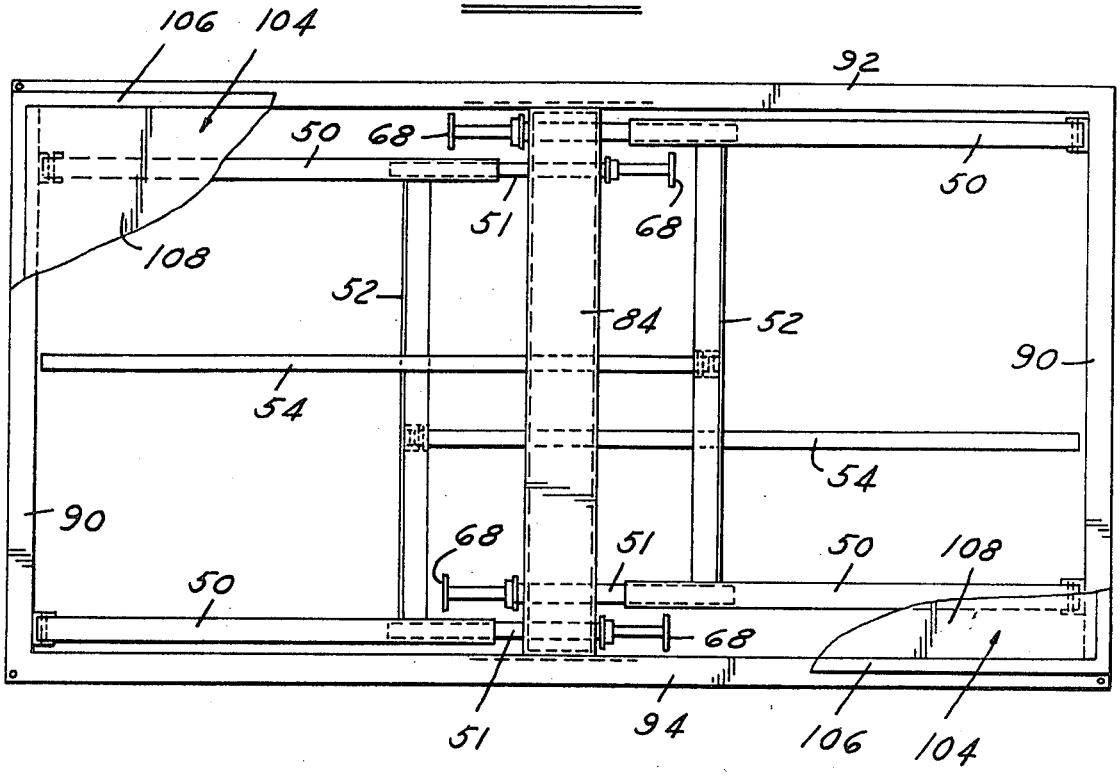

FIG. 14, a top breakaway view taken on line 14—14 of FIG. 4.

Figure 15:
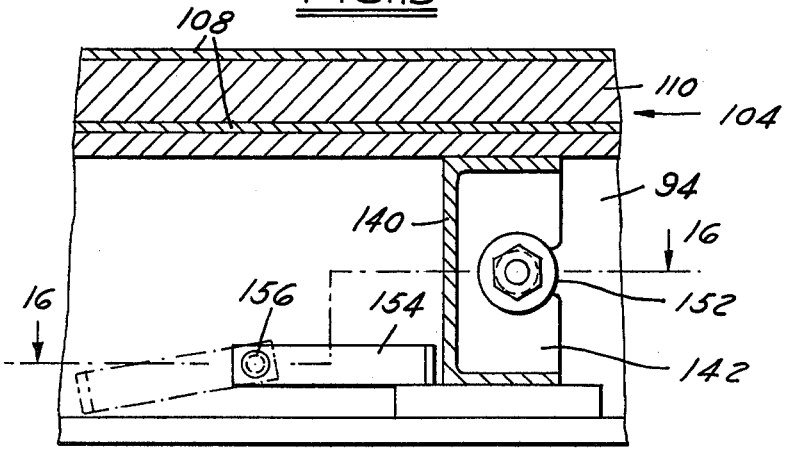

FIG. 15, an illustration of a modified joist lock.

Figure 16:
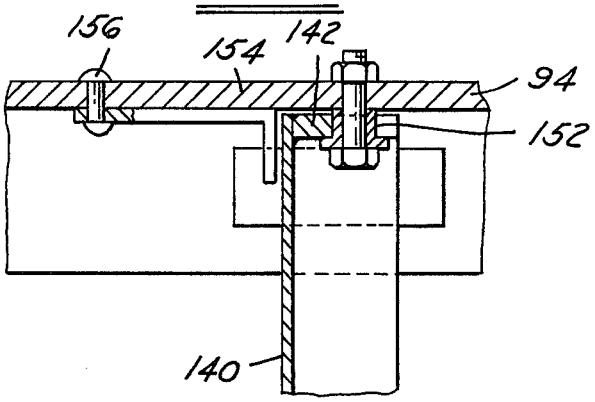

FIG. 16, a sectional view on line 16—16 of FIG. 15.

Figure 17:
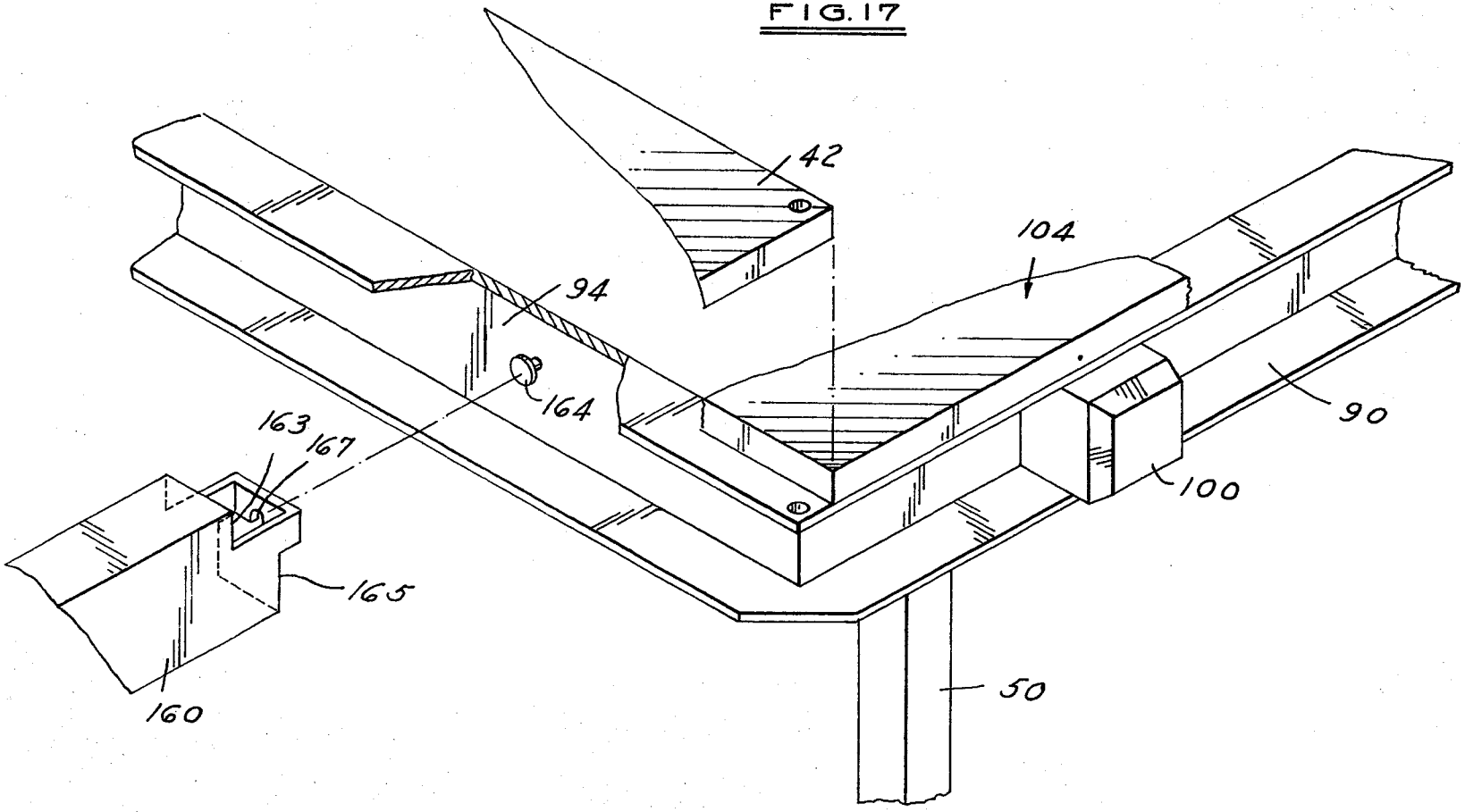

FIG. 17, a perspective view of a modified type of joist construction.

Figure 18:
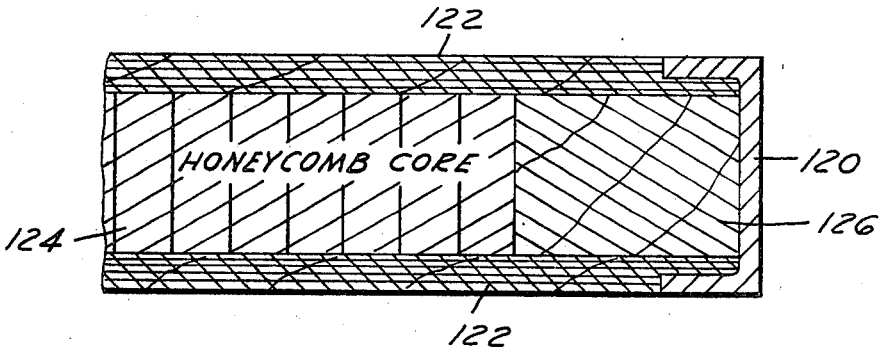

FIG. 18, a sectional view of a modified panel construction.

REFERRING TO THE DRAWINGS

In FIGS. 1, 2 and 3, the assembled platform panels are illustrated. In FIG. 1, a top view shows a series of panels 20, 22 and 24 on the left side, panels 26, 28 and 30 in an alternate row, and panels 32, 34 and 36 in a second alternate row. These units are the panels which have supporting stanchions at each corner. Between these panels are drop-in panels 38, 40 and 42 in the second row from the left, and panels 44, 46 and 48 in the alternate row and so on. These drop-in panels are supported by insertable joists between the stanchioned panels.

In FIG. 2, an end view of this assembly shows the panels 24, 42, 30, 48 and 36 in series from left to right. Panels 24, 30 and 36 are shown with the vertical stanchion supports 50 at each corner, with horizontal cross bars 52 across the ends of these units, upper diagonal braces 54 extending from the cross bars to the panels, lower diagonal braces 56 in the end view (FIG. 2), and lower diagonal braces 58 in the side view (FIG. 3). Each stanchion 50, FIG. 12, consists of a square tube, in the example shown. Telescoping inside the tube 50 is a smaller tube 51 (FIGS. 2, 3, 4, 12, 14). Tube 51 has multiple holes 53 (FIG. 12) which will align with holes 55 (FIG. 11) in stanchions 50. Tubes 50 and 51 are locked together with pins (not shown) through the holes 53 and 55. This provides a coarse height adjustment (for example, 4′ to 6′ or 5′ to 8′). The bottom of telescoping tube 51 has a short insert 60 telescoping into the lower end with an apertured plate 62 at the bottom of the insert welded to a nut 64. A threaded leveling adjustment rod 66 with a foot pad 68 extends into the tube 51 of stanchions 50 having a collar 70 at the top. A coil spring 72 surrounds the threaded rod 66 to urge it upwardly in the stanchion tube.

In FIG. 10, the horizontal cross-bar or cross-brace 52 between the rectangular stanchions 50 is welded or otherwise secured at each end to the stanchions in suitable braced interengagement and this cross-brace carries a bracket 80 in which is pivoted one end of the upper diagonal brace 54.

As shown in FIG. 4, the braces 54 engage the panel at 82 at a cross joist 84 in a releasable connection to permit the collapsing of the stanchions on disassembly.

The lower end and side diagonal supports 56 and 58 are clamped on to the square cross-sectioned stanchions 50 in a manner best shown in FIG. 11. Each lower diagonal cross-bar 56, for example, in the form of a square tubing has a U-shaped bracket 86 securedly fastened thereto at a predetermined angle and this bracket has a dimension which will cause it to have a slip fit over the stanchion 50. A short slide tube 88 has a dimension which will embrace the upright stanchion 50 and the bracket 86 so that, as shown in FIG. 11, the slide tube 88 drops down over the bracket 86 to hold it securely against the stanchion. The same arrangement pertains at the other end as shown, for example, in FIG. 4.

The stanchion supported panels 20, 22, 24, and so on, are each preferably formed as a rectangular frame from U-shaped angle members shown best in FIGS. 11 and 14, with an end run 90 and side runs 92 and 94. Between the outwardly extending flanges of the edge end run 90, these are spaced elements for an end interlock. Short vertical elements 96 form a recess 98 near one end, and at an equal distance from the other end of the run 90 is an interlock block 100. Each of the panels will have similar recesses and blocks for interengagement endwise to provide a rigid connection, each end run 90 having a bolt hole 102 to receive a bolt (not shown) to lock these two parts together in assembly.

Secured to the top of the upper flange of the angle frame is a support panel 104 which can be formed of extruded aluminum frame elements 106 mitered at the corners and a composite panel formed of masonite sheets 108 (FIG. 9) on top and bottom sandwiching a particle board insert 110.

As shown in FIGS. 7 and 8, an aluminum corner piece 112 forms a corner insert within the flanges of the extruded aluminum frame members 106 and a headed bolt 114 passes through the upper flange of side run 94 as shown into the corner piece to lock the top panel 104 to the frame members. These panels 104 are preferably formed, as shown in FIG. 18, with an aluminum edge strip 120 with plywood skin sheets 122 sandwiching a reinforcing phenolic impregnated paper honeycomb core 124. A solid wood edge strip 126 surrounds the core inside the aluminum edge frame 120. This structure, shown in FIG. 18, would be a lighter structure and a little easier to handle in assembly and disassembly. Alternatively, these panels can be solid plywood with a commercially available non-skid surface on top. ("Skid-Guard" is the commerical name for one of these products).

In FIG. 14, a top view of the main stanchioned panel is illustrated with the top panel 104 broken away to show the various elements. It will be seen that the frame formed on the end elements 90 and the side elements 92, 94 is reinforced centrally by U-shaped joist 84 which is welded to the frame.

The illustration in FIG. 14 shows the adjustable stanchions 50 and telescoping inserts 51 folded against the bottom of the panel with the crossbars 52 parallel to the panel and the upper diagonal cross-braces 54 nested in the assembly.

When this unit is arranged for use, the stanchions 50 are dropped down to vertical position and the upper diagonal braces 54 locked into the joist 84. The ends of each assembled unit are fitted together so that the recesses 98 cooperate with the lock blocks 100. Thus, a row of these assembled panels will be placed end-to-end as shown in FIG. 1 at 20, 22 and 24. A second row of panels 26, 28 and 30 are assembled in spaced relation. Between these two rows, independent removable spacer support joists 140 or 160 are inserted. These joists 140 or 160 are interlocked with the upright panels as shown in FIG. 11.

Each joist 140 has an end plate 142 notched at 144. This plate will engage with a plate 146 on the panel 94 of an assembled unit. A spring strike-out tab 148 is pressed in during assembly and the joist moved laterally so that the notch 144 engages a bossed stud 150. Upon this engagement, the spring tab 148 will spring outwardly and lock the parts in the assembled position. Each end of the spacer joists 140 is fastened in this way. When disassembling, the tabs 148 are pressed in to allow removal of the joists from the studs 150.

Optional locking devices are shown, for example, in FIGS. 15 and 16. The joist 140 has the same structure with the notched end tab 140 which cooperates with a bossed stud 152, and an L-shaped latch member 154, pivoted at 156, swings against the back of the spacer joist 140 to lock it in position until intentionally released.

In FIG. 17, a preferred modification is shown in which a spacer joist 160 has a notched cross-piece 162 in the end which drops over a bossed stud 164 on the side angle 94 so that it is held in place by gravity and the covering panel so that no spring latch or mechanical latch is required.

With reference to FIG. 17, it will be noted that the top of the structural joist 160 is cut away at the top at 163 and the cross-piece mounted at the top of the cut-away. The bottom corner of the joist is also notched at 165. Accordingly, in assembly, the end of the joist is inserted between the flanges of the table element 94 and the notch 165 makes it possible to move the joist sideways providing clearance for the head of the stud 164. The notch 163 permits the end of the joist to be lifted high enough to go over the stud and allow the cross-piece to move over and drop down with the stud in the notch 167. The bottom edges of the joist behind the notch 165 then rest on the bottom flange of the table element 94.

The assembled spacer joist is shown best in FIG. 13. There are preferably three joists in each space between the supported panels and when the spacer joists 140, or the optional joists 160, are in place between the stanchion supported panels, then supplemental panels 38, 40, 42, etc. are dropped into place as shown in FIG. 1 and supported on the joists while located horizontally by the adjacent panels 104. The supplemental panels are formed in the same manner as panels 104 with the masonite sheets 108 sandwiching a filler board 110 or as preferred panels 126 previously described.

As illustrated in FIGS. 5 and 6, stanchions 50 are pivoted on U-shaped brackets 180 by bolts 182, these brackets being riveted to the end frame members 90. Tables are fastened together endwise by a bolt which goes through the matching holes in members 90. (One hole is shown in FIG. 17.)

In FIGS. 5 and 6, the corner abutment of the support panels is illustrated. The lock block 100 is shown in the recesses 98 with the stanchions 50 in vertical position. Removable joists 160 are dropped in place (FIG. 17) or removable joists 140 are locked in place by clips 148 on the bossed studs 152, and the drop-in panels 126 (FIG. 18) or 104 (FIG. 7) are positioned over these joists between the fixed panels which are bolted to the frame members 90, 92, 94. Straps 190 are carried by the joists 140 to pivot out to a suitably positioned lug 192 on an adjacent joist to lock the joists together. These straps fold inside the joists upon disassembly.

It will be evident in viewing FIG. 14, that the stanchioned panels will support the stanchions and upper braces in folded position as a first basic element of the system. The second elements are the drop-in panels and third elements are the removable joists 140 or 160. The lower attachable braces 56 and 58 complete the assembly units. The portable elements may quickly and easily be set up and locked together at selected heights to provide a solid and level platform which will have adequate floor strength for seating or other group presentation purposes.

I claim:

1. A portable stage system which comprises:
(a) a plurality of first floor panels,
(b) stanchions movable to a position to support each of said first floor panels,
(c) means on opposite sides of said first floor panels to interengage to effect interlock of a plurality of said first floor panels on said sides in spaced aligned rows,
(d) spacer joists to lie horizontally between said spaced aligned rows in interlocking engagement with said first floor panels,
(e) a plurality of second floor panels supported on said joists to fill the space between said aligned rows to provide a continuous floor surface,
(f) said first floor panels comprising a rectangular frame of U-shaped angle members, the flanges facing outward, and a flat panel lying atop said frame and secured thereto,
(g) a bossed projection mounted between said flanges on the base of the U-shaped angle members,
(h) a joist to cooperate with said flanges and said boss comprising an elongate structural member,
(i) a cross-piece at an outer end having a slot to engage behind the head of the bossed projection,
(j) said joist having a first notched portion below said cross-piece to allow said joist end to move transversely over said boss and a second notched portion at the top to allow said joist end to move upwardly under the top flange of the angle member a distance sufficient to allow movement over the boss and to seat the boss in said slot, the bottom of the joist behind said first notched portion resting on the bottom flange of the angle member in assembly.

2. A portable stage system which comprises:
(a) a plurality of first floor panels,
(b) stanchions pivoted to each end of said first floor panels, each stanchion comprising adjustable first and second support legs pivotally movable from a collapsed storage position adjacent the bottom of the first floor panels to a supporting position normal to said panels,
(c) means to locate and stabilize said stanchions in supporting position,
(d) telescoping means on opposed ends of said first floor panels to interlock said ends when said panels are placed together end to end in a first rank of panels,
(e) a second rank of first floor panels arranged parallel to and spaced from said first rank of panels,
(f) a plurality of horizontal joists connecting said panels in said first and second ranks,
(g) a plurality of second floor panels supported between said spaced ranks of floor panels on said joists, and
(h) a plurality of diagonal brace members extending between and secured to said first support legs of said stanchions in said spaced ranks of first floor panels to rigidify said ranks into a stable floor structure.

3. A portable stage system as defined in claim 2 in which said diagonal brace members comprises elongate brace members having at each end an open sided U-shaped receptacle disposed at an angle to said brace members and dimensioned to receive said support legs through the open side to lie vertically embracing said legs, and a slip collar on said legs to slide over said receptacles to removably clamp said receptacles on said legs, said braces serving as a limit stop for said slip collars.

4. A portable stage system as defined in claim 2 in which each said first and second floor panels comprise a rectangular frame of U-shaped side and end metallic members with top and bottom flanges extending outwardly from the edges of the panels, floor support plates supported on said frame dimensioned to leave outside portions of the top flanges of the side frame extending beyond the floor support, said joists being connected to said frame members between the upper and lower flanges, and said second floor panels being supported by said joists and at the side edges by said outside portions of said side flanges.

* * * * *